US009939211B2

(12) United States Patent
Höglund

(10) Patent No.: US 9,939,211 B2
(45) Date of Patent: Apr. 10, 2018

(54) CHANNEL PLATE HEAT TRANSFER SYSTEM

(71) Applicant: ALFA LAVAL CORPORATE AB, Lund (SE)

(72) Inventor: Kasper Höglund, Rönninge (SE)

(73) Assignee: ALFA LAVAL CORPORATE AB, Lund (SE)

( * ) Notice: Subject to any disclaimer, the term of this patent is extended or adjusted under 35 U.S.C. 154(b) by 692 days.

(21) Appl. No.: 14/376,293

(22) PCT Filed: Mar. 14, 2013

(86) PCT No.: PCT/EP2013/055237
§ 371 (c)(1),
(2) Date: Aug. 1, 2014

(87) PCT Pub. No.: WO2013/135813
PCT Pub. Date: Sep. 19, 2013

(65) Prior Publication Data

US 2015/0021002 A1 Jan. 22, 2015

(30) Foreign Application Priority Data

Mar. 12, 2014 (EP) ..... 12159461

(51) Int. Cl.
*F28F 3/02* (2006.01)
*F28F 3/04* (2006.01)
(Continued)

(52) U.S. Cl.
CPC ..... *F28F 3/025* (2013.01); *F28F 3/046* (2013.01); *F28F 3/12* (2013.01); *F28F 13/06* (2013.01); *F28F 13/12* (2013.01)

(58) Field of Classification Search
CPC .... F28F 3/025; F28F 3/046; F28F 3/12; F28F 3/08; F28F 3/083; F28F 3/10; F28F 13/06;
(Continued)

(56) References Cited

U.S. PATENT DOCUMENTS 4,182,411 A * 1/1980 Sumitomo ..... F28B 1/02 165/110
4,313,494 A * 2/1982 Bengtsson ..... F28D 1/0316 165/148
(Continued)

FOREIGN PATENT DOCUMENTS

CA 2 431 732 A1 12/2004
CH 413881 5/1996
(Continued)

*Primary Examiner* — Tho V Duong
(74) *Attorney, Agent, or Firm* — Birch, Stewart, Kolasch & Birch, LLP

(57) ABSTRACT

A flow-plate is dividable in mid plane. The flow-plate includes two parts, each part includes a channel side and a utility side, and the two parts of the flow plate are counter parts and complementing each other. When the flow-plate is connected the two parts form a channel between the two counter parting channel sides. The channel includes curved obstacles, sidewalls and channel floors. The curved obstacles are lined up in parallel rows separated by sidewalls, the backside of the rows of curved obstacles have deep machined grooves making the obstacles hollow for heat transfer fluids on utility sides. A flow-plate section and a flow module are also disclosed.

19 Claims, 9 Drawing Sheets

(51) Int. Cl.
*F28F 3/12* (2006.01)
*F28F 13/06* (2006.01)
*F28F 13/12* (2006.01)

(58) Field of Classification Search
CPC ..... F28F 13/12; F28F 2275/08; B01J 2219/00306; B01J 2219/2493; B01J 2219/2453; B01J 2219/2459; B01J 19/24; B01J 19/249; B01J 19/32; B01J 19/305
See application file for complete search history.

(56) References Cited

U.S. PATENT DOCUMENTS

| | | | | | |
|---|---|---|---|---|---|
| 4,470,454 | A * | 9/1984 | Laughlin | F28D 9/0012 | 165/166 |
| 4,492,268 | A | 1/1985 | Uehara et al. | | |
| 4,586,562 | A * | 5/1986 | Carlson | F28F 19/004 | 165/134.1 |
| 4,976,313 | A * | 12/1990 | Dahlgren | F28F 3/083 | 165/166 |
| 5,107,922 | A | 4/1992 | So | | |
| 5,560,425 | A * | 10/1996 | Sugawara | F28D 1/0316 | 165/148 |
| RE35,890 | E | 9/1998 | So | | |
| 5,904,893 | A | 5/1999 | Stein | | |
| 6,131,648 | A * | 10/2000 | Rasmussen | F28F 3/042 | 165/145 |
| 6,478,081 | B1 * | 11/2002 | Shaw | F28D 9/005 | 165/167 |
| 7,419,644 | B2 | 9/2008 | Chopard | | |
| 7,919,056 | B2 | 4/2011 | Roberge et al. | | |
| 8,778,285 | B2 * | 7/2014 | Hoglund | F28F 3/083 | 422/560 |
| 2002/0029872 | A1 | 3/2002 | Jamison et al. | | |
| 2003/0192681 | A1 | 10/2003 | Yamauchi et al. | | |
| 2006/0124287 | A1 | 6/2006 | Reinders | | |
| 2007/0056719 | A1 | 3/2007 | Katoh | | |
| 2009/0288812 | A1 | 11/2009 | Feng et al. | | |
| 2010/0230085 | A1 | 9/2010 | Feng et al. | | |
| 2011/0120685 | A1 | 5/2011 | Van Heeswijk et al. | | |
| 2012/0285670 | A1 * | 11/2012 | Hoglund | B01J 19/249 | 165/166 |

FOREIGN PATENT DOCUMENTS

| | | | | |
|---|---|---|---|---|
| CN | 101586928 | A | 11/2009 | |
| DE | 681318 | | 9/1939 | |
| DE | 953 978 | | 12/1956 | |
| DE | 3112748 | A1 | 10/1982 | |
| DE | 92 04 152.3 | U1 | 5/1992 | |
| EA | 009344 | B1 | 12/2007 | |
| EP | 0 022 025 | A2 | 1/1981 | |
| EP | 0 065 679 | A1 | 12/1982 | |
| EP | 1 291 320 | A1 | 3/2003 | |
| GB | 256693 | | 8/1926 | |
| GB | 622355 | | 4/1949 | |
| JP | 49-85649 | A | 8/1974 | |
| JP | 2003-307397 | A | 10/2003 | |
| JP | 2007-78280 | A | 3/2007 | |
| JP | 2008121956 | A * | 5/2008 | F28F 3/046 |
| RU | 2 100 733 | C1 | 12/1997 | |
| WO | WO 95/31686 | A1 | 11/1995 | |
| WO | WO 97/21967 | A1 | 6/1997 | |
| WO | WO 2008/085522 | A1 | 7/2008 | |

* cited by examiner

CHANNEL PLATE HEAT TRANSFER SYSTEM

The present invention relates to a flow-plate, an assembled flow-plate section, a flow module comprising the flow-plate, use of the flow module as a plate reactor.

BACKGROUND

The heat transfer to or from a process flow in a channel of a continuous plate reactor or a continuous flow module is usually carried out on both sides of the channel plate by heat transfer plates, which work as barriers between process and utility fluids. When scaling up, i.e. increasing the cross section of the process flow channels, the heat transfer surface to volume ratio decreases, this could result in insufficient heat transfer capacity. Insufficient cooling may result in producing more bi-products etc. which should be avoided.

THE INVENTION

Accordingly, the present invention finds a solution to the above mentioned technical problem by providing a new flow-plate concept. Thus, the present invention relates to a flow-plate heat transfer system, said flow-plate heat transfer system comprise a plate which is dividable into two parts in mid plane, i.e. two channel sides and two utility sides of the channel plate. The two parts of the flow-plate heat transfer system, i.e. the flow-plate, are complement of each other and put together form a process channel between the two channel sides. The channel sides of the flow-plate comprise curved channel formed obstacles, side walls and process channel walls. The obstacles, i.e. the curved channel formed obstacles, are lined up in rows separated by the side walls, and the backside of the rows of obstacles are deep machined with grooves making the obstacles hollow for heat transfer fluids on the utility sides.

Thus, one aspect of the invention relates to a flow-plate, which is dividable in mid plane, said flow-plate comprises two parts, each part comprises a channel side and a utility side. The two parts of the flow plate are counter parts and complementing each other. Each channel side comprises parallel rows of obstacles, sidewalls and parallel rows of channel floors. Said sidewalls are separating said parallel rows of curved obstacles, and said sidewalls are also separating said parallel rows of channel floors. The rows of curved obstacles are complementing said rows of channel floors to form a channel between the two channel sides of said flow plate. The utility sides of the rows of curved obstacles have deep machined grooves. Said deep machined grooves are lined up in parallel rows on the utility sides of the flow-plate, and the rows of deep machined grooves are perpendicular to the channel. The rows of deep machined grooves are for flow of heat transfer fluids on the utility sides.

The channel has a serpentine type of pass through the plate and the channel is formed between a first sidewall and a second sidewall, and so on. The channel is also formed between the curved obstacles, and the channel floors. The pass between curved obstacles and channel floors enhances the mixing of the process flow in the channel.

The flow-plate may be divided into two parts by parting the plate in its mid plane, and that the complex structure of the channel could be simplified and thus easier to manufacture. Between the two parts may a gasket seal the process channel of the flow-plate when the flow-plate is mounted within the flow module or the plate reactor.

The flow-plate may further comprise two turbulator plates, said turbulator plates may be designed to cower the rows of deep machined grooves formed on the backside of the rows of lined up obstacles. Each one of the turbulator plates may have two sets of holes, each set of holes in a separate row on each end of the turbulator plate. The sets of holes may be communicating with the rows of deep machined grooves on the backside of the obstacles. In each row of the deep machined grooves may bars be fitted corresponding to the sidewalls, which are separating the rows of the formed process channel within the flow-plate. The side walls are passing the rows of obstacles, and are thus forming the bars within the deep machined grooves. The bars promote mixing of the heat transfer fluids and increase the heat transfer surface of the flow-plate, which also enhance heat transfer to and from the fluids flowing within the process channel. The two counter parts of the flow-plate could be moulded, could be machined, or could be combinations of moulded and machined.

Clearance slots between the sidewalls and the bars may be for small bypass of process fluids, which bypass fluids could keep the flow-plate clean during operation, and could improve the handling of the flow plates during assembling and during dissembling.

The deep machined grooves of the flow-plate may have inserted turbulators. The turbulators may be selected from metallic foam, offset strip fin turbulators, or turbulator wings arranged on strips connected to the turbulators on the utility side, preferably the inserted turbulators may be turbulator wings arranged on strips connected to the turbulators. The turbulators are for enhancing turbulence within the grooves and thus the heat transfer to and from process flow within the channel.

Two barrier plates may be closing the flow-plate, one barrier plate on each utility side of the flow-plate. Inlets and outlets for heat transfer fluids may be arranged on each barrier plate.

The formed channel in the flow-plate may have at least one turning box, which turning box may be a space or a room between two adjacent rows of obstacles in the flow-plate. The turning boxes enables communication between two adjacent rows of obstacles, i.e. two channel rows, such that fluids may flow from one row to the other in the space of the turning box. Each turning comprises two compartments divided by a wall. In each compartment of the turning box is one mini-obstacle arranged for creating a three dimensional flow and enhanced mixing of the process flow in the channel. The flow of fluids flow from a first channel row to a second channel row in the turning box. By use turning boxes it is possible to create a true three dimensional flow to give an enhanced mixing of the process flow. One or more access ports or one or more port holes, or combinations thereof may provide access to the process channel preferably access to the turning boxes. At both ends of the process channel may at least one inlet be connected, and at least one outlet may be connected to the other end of the process channel. Nozzles, which may be inserted in the access ports or the inlets, can be selected form any suitable nozzle and examples of nozzles are injection nozzles, dispersion nozzles, re-dispersion nozzles, re-mixing nozzles, coaxial nozzles, tube nozzles etc. A coaxial nozzle could be selected for the inlet port and be defined as a nozzle with two or more tubes arranged within each other, that a larger tube having a large radius is surrounding a smaller tube having a smaller radius. When such a nozzle is used two or more fluids can be mixed or form dispersions. A re-mixing nozzle could be a tube nozzle having a hole with a nozzle head and the hole has a smaller radius than the tube. The nozzle may be a dispersion nozzle which can have one or more holes at the outlet of the dispersion nozzle and the holes can be arranged in concentric circles or the holes can be arranged in other suitable patterns.

The access ports or the port holes may have inserted port-fittings. The port-fitting may comprise fastening element and a seal arranged either externally on said shaft or the seal may be arranged at the second end portion facing away from the head, or the seal may be arranged in the short side of said second end portion. The seal may seal the port hole together with port-fitting from the fluids flowing in process channel. The port-fitting may also be a plug which closes the port hole or access port. The port-fitting may be equipped with an inlet, an outlet, a nozzle, a sensor unit, a thermo couple, a spring-loaded sensor or a resistance thermometer. Any kind of equipment which would monitor the flow of fluids within the process channel may be arranged within the port-fitting.

The present invention relates also to an assembled flow-plate section, which flow plate section comprises a flow-plate according to the invention. In the assembled flow section is the flow-plate arranged as a core. The flow plate is dividable in mid plane and comprises two channel sides and two utility sides. Between the two channel sides is a channel formed by curved sides of obstacles. The channel is sealed by a gasket between the two counter parting channel sides. Two utility sides are lined up by the backsides of the rows of curved obstacles and the backsides have deep grooves for heat transfer fluids. On each side of the two utility sides are a frame plate, an O-ring, a turbulator plate, and also a barrier plate arranged. The two barrier plates are closing the assembled flow-plate section which comprises the flow plate.

The assembled flow-plate section comprises also that each barrier plate have cut-open parts for distribution of heat transfer fluids into grooves on the backsides of the obstacles and into utility channels which are formed by turbulator plates and barrier plates. In the cut-open parts of the barrier plates are inlets or outlets respectively arranged for heat transfer fluids.

The utility flow or the heat transfer fluid could be divided to flow through the two utility plates, i.e. one stream on each side of the flow-plate, and could be collected at the outlet. Process and utility sides could thus be totally separated, and there would be no interfaces with seals between the fluids. Therefore, all seals would be towards atmosphere.

The present invention relates also to a flow module, preferably a continuous plate reactor, which flow module comprises one or more flow-plate systems of the invention and a clamping device. The clamping device comprises a frame, two end plates, disc springs, and tension rods. The piles of disc springs could be arranged as a grid of springs supported on the end plates to distribute clamping forces on flow-plates, which flow-plates are placed between the two end plates.

The flow module may also comprise that the clamping device comprises two U-formed end sections, end plates, two beam webs at each end plate. Each long sides of beam webs has at least one notch in which at least one tongue of the end plate is fitted, in such a way that an U-formed end section is formed.

The flow module could also comprise other types of plates with different functions one example of such plates is a residence time plate. The flow module is not limited to the example, other types of plates are also possible. The residence time plate may be for example completing a reaction and thus providing longer residence time in the flow module. Thus, the flow module also comprises one or more residence time plates. The residence time plates may comprise two or more chambers connected in series, and the chambers are separated by parallel walls, each wall has a hole or a passage, which hole or passage is a communication between two cambers. The holes or the passages in the walls may be alternating on the right hand side or the left hand side of residence time plate, and residence time plate has at least one inlet and at least one outlet. The chambers may be equipped with inserts selected from the group consisting of folded sheet inserts, baffle ladder sheet inserts, stacked sheets inserts, metallic foam, offset strip fin turbulators or combinations thereof. Preferably the flow module may have inserted folded sheet inserts, which folded sheet inserts comprises baffles which may be shifting place in each folds in an alternating fashion that they form a zigzag pattern with alternating heights of the baffles.

The present invention relates also to the use of the flow module as a plate reactor. Further embodiments and aspects of the invention are defined by the independent claims and the dependents claims.

Other aspects and advantages of the invention will, with reference to the accompanying drawings, be presented in the following detailed description of embodiments of the invention. The below figures are intended to illustrate the invention and are only examples of the invention, and as such not to limit the scope of the invention.

DETAILED DESCRIPTION

Figure 1:
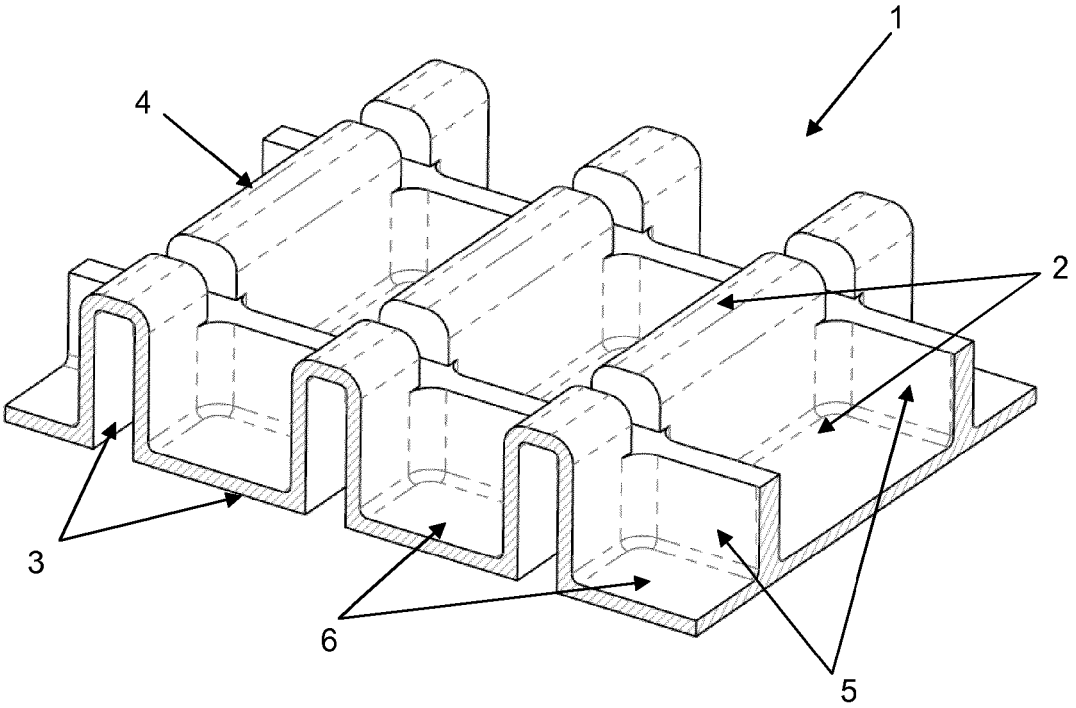
FIG. 1 is showing a principal layout of one of the parts of a flow plate, which flow plate is divided in mid plane.

FIG. 1 is disclosing a principal layout of one of the parts of a flow plate 1, which flow plate 1 is divided in mid plane into two mirroring counter parts. The counter parts have each a channel side 2 and a utility side 3. On the channel side there are curved obstacles 4, sidewalls 5 and channel floors 6.

Figure 2:
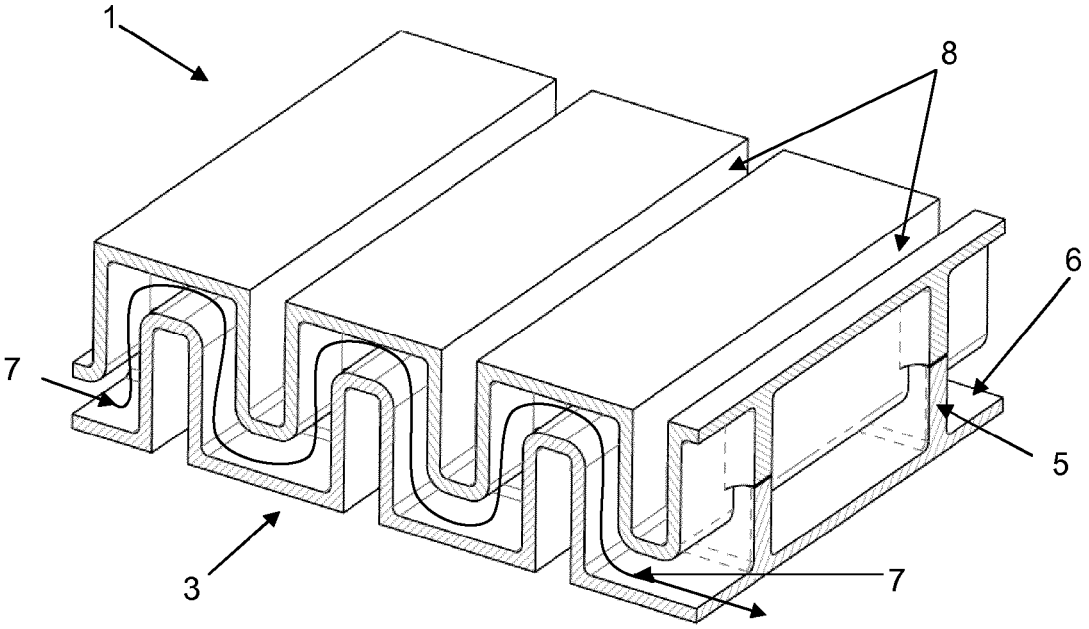
FIG. 2 is showing two connected counter parts of the flow plate.

In FIG. 2 the two parts of the flow plate are put together and the parts are counter parts and mirroring each other. When the flow parts are connected they form a channel 7 between the two counter parting channel sides. Channel 7 is limited by curved obstacles 4, sidewalls 5 and channel floors 6, and each obstacle 4 is arranged opposite channel floor 6, and channel 7 is divided by sidewalls 5 on each side of channel 7. Channel 7 will have a serpentine type of direction within the space created by obstacles 4, channel floors 6 and side walls 5, and the direction of the channel will thus going up, going down and going forward. Said curved obstacles 4 on each flow part are lined up in rows separated by sidewalls 5, said lined up rows of curved obstacles 4 have deep grooves 8 which make obstacles 4 and part of sidewalls 5 hollow for heat transfer fluids on utility sides 3. Grooves 8 are lined up parallel to each other on the flow plate, and grooves 8 are perpendicular to channel 7.

Figure 3:
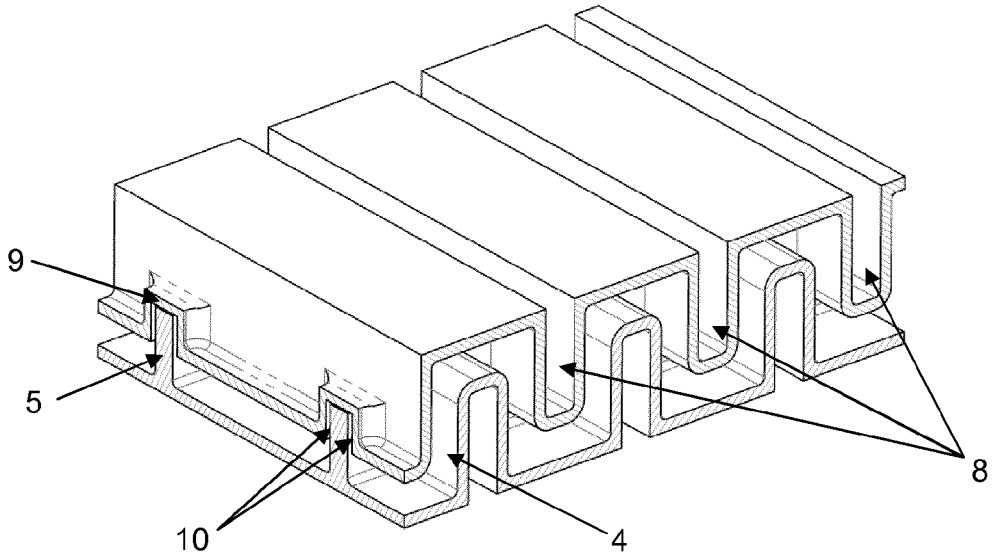
FIG. 3 is showing utility grooves of the flow plate.

FIG. 3 is showing how sidewalls 5 are passing grooves 8 and may constitute bars 9 within grooves 8. Bars 9 promote mixing of heat transfer fluids and increase the heat transfer surface of the flow plate, which also enhance heat transfer to and from the fluids flowing within channel 7. Between sidewalls 5 and bars 9 are clearance slots 10 for small bypass flow to keep clean during operation of the flow module. Clearance slots 10 improve also the handling of the flow plates during assembling and during dissembling.

Figure 4:
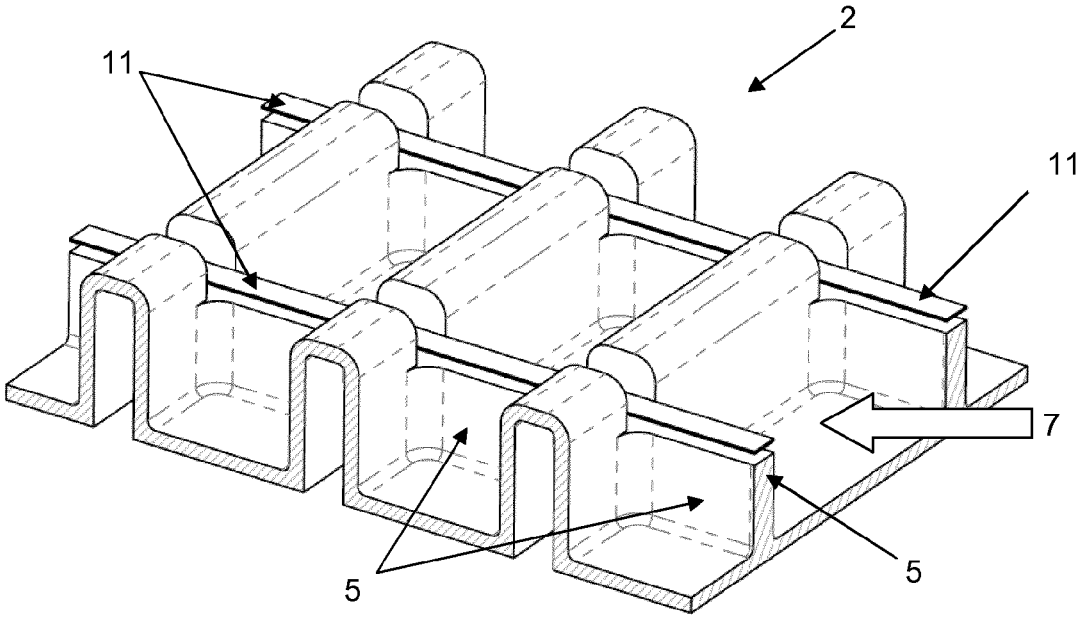
FIG. 4 is showing how a gasket is sealing the channel.
Figure 5:
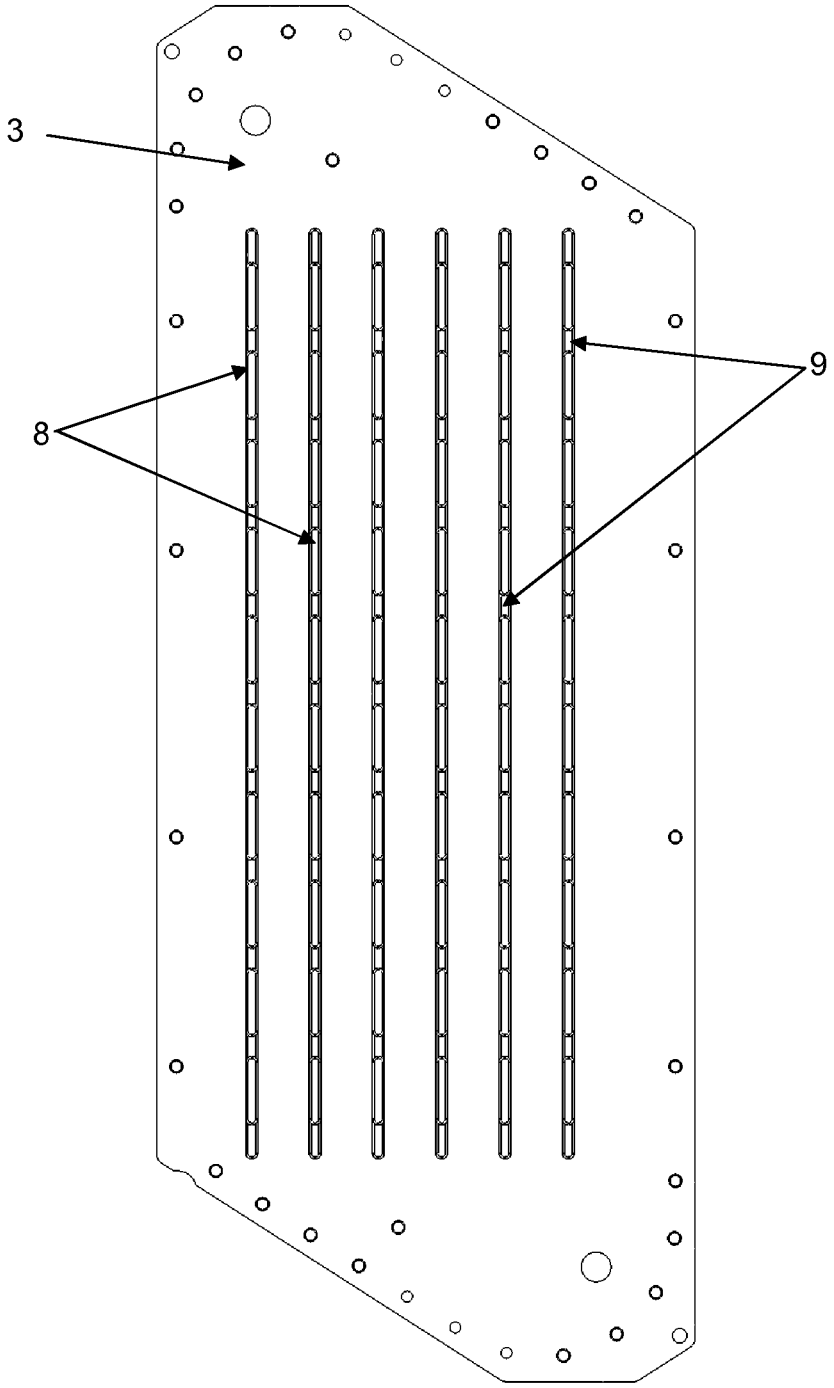
FIG. 5 is showing the parallel grooves for heat transfer fluids seen from the utility side of the flow plate.

FIG. 4 is disclosing how a gasket 11 is placed on one channel side 2 for sealing the two channel sides to each other, and thus channel 7. Gasket 11 is arranged on sidewalls 5. FIG. 5 is showing flow-plate 1 seen from utility side 3. From this view can parallel grooves 8 for heat transfer fluids be seen. Sidewalls 5 may constitute bars 9 in grooves 8, this can also be seen in FIG. 5. Bars 9 promote turbulence of the flow of heat transfer fluids and thus heat to and from channel 7.

Figure 6:
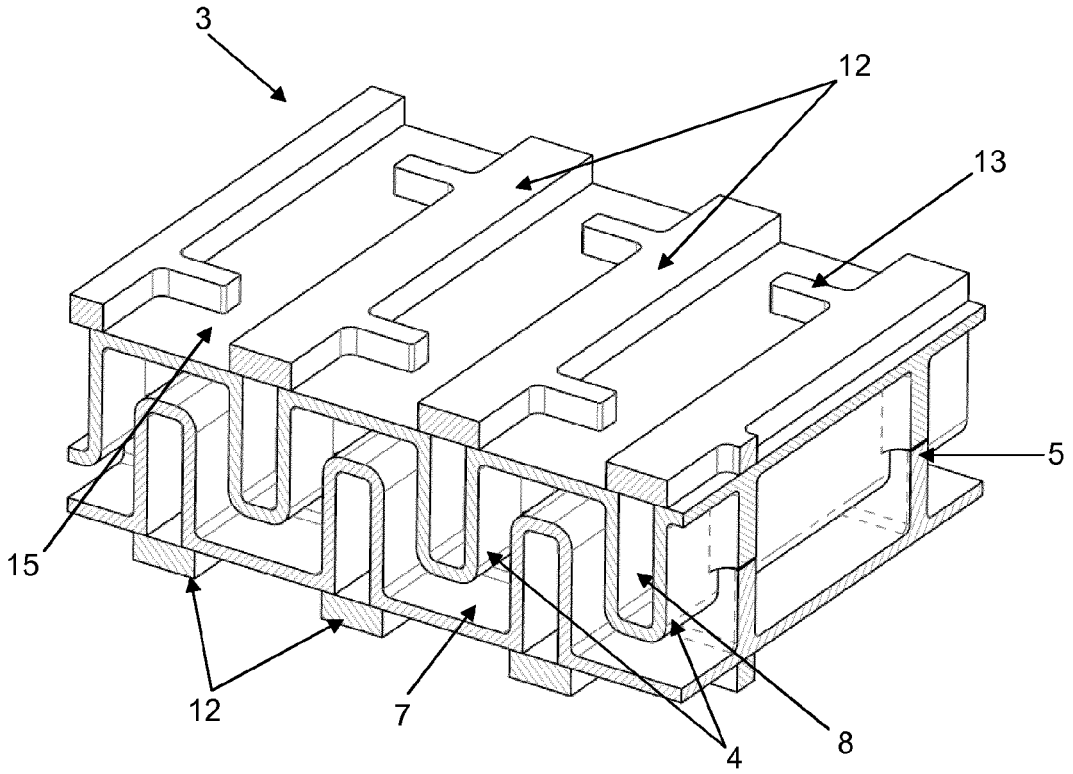
FIG. 6 is showing how the grooves are covered by the turbulators on the utility side of the flow plate.

FIG. 6 discloses how grooves 8 are covered by turbulator (s) 12 on utility side 3. Turbulator 12 can have fins 13, but other alternatives are also possible. The heat transfer fluids are flowing both in grooves 8 in obstacles 4 on utility side 3, and on the utility side passing turbulator 12 with the mixing promoting fins 13, which turbulator is constructed to provide the desired turbulence of the flow of heat transfer fluids. The process fluid within channel 7 is heated or cooled along the channel rows from utility sides 3 and from grooves 8 within curved obstacles 4.

Figure 7:
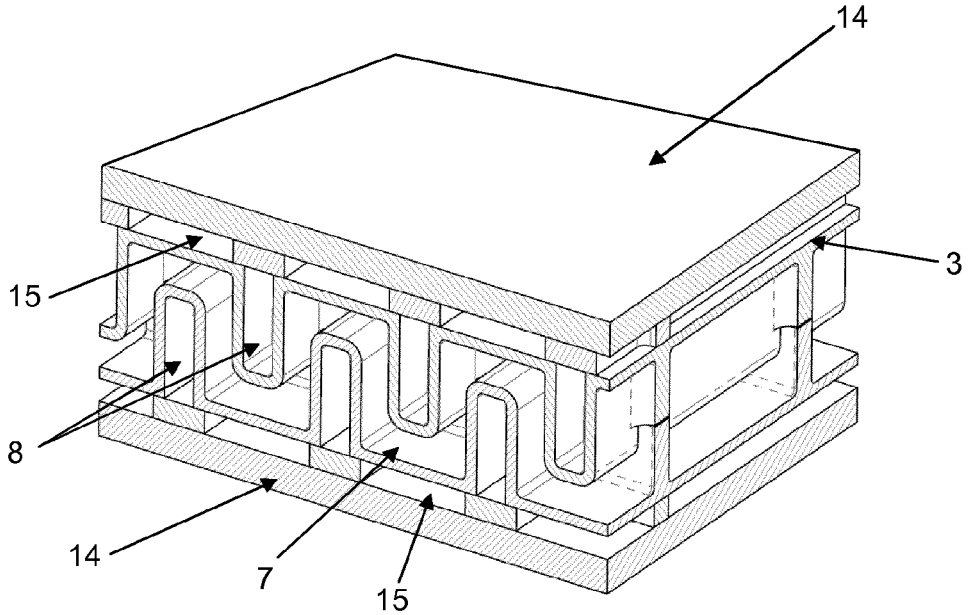
FIG. 7 is showing how two barrier plates are arranged on top of the two utility sides.

In FIG. 7 two barrier plates 14 are arranged on top of the two utility sides 3 and cover the opposite side of the created utility channels 15 enabling heat transfer fluids to flow in created utility channels 15 and in deep groves 8. By passing the flow of utility fluids in utility channels 15 and in deep groves 8 it is possible to enhance transfer of heat to and from the process flow in channel 7.

Figure 8:
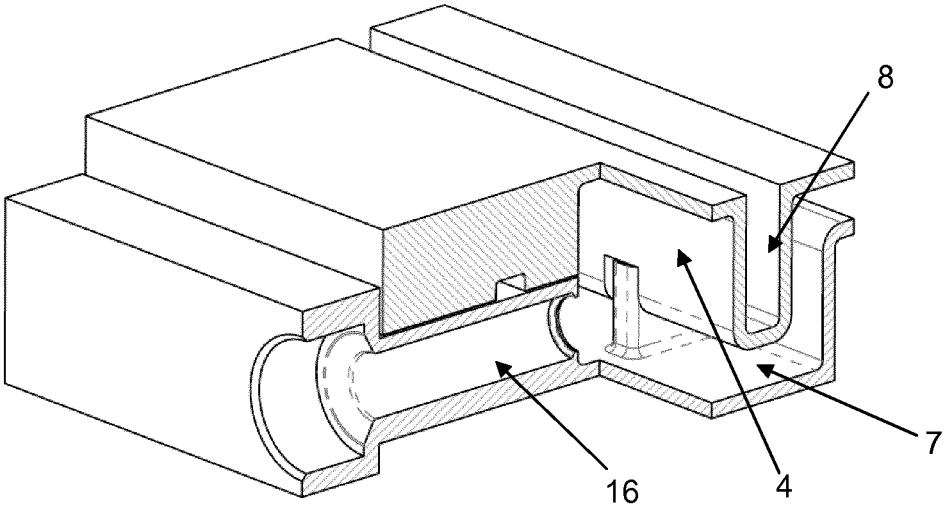
FIG. 8 is showing a port hole which has access to the channel.

FIG. 8 shows how one or more access ports 16 or one or more port holes 16, or combinations thereof are providing access to channel 7. At least one of ports 16, i.e. the access ports or the port holes, is an inlet connected to channel 7, and at least one of the ports 16, i.e. the access ports or the port holes an outlet from channel 7. FIG. 8 shows also an obstacle 4 with deep groove 8.

Figure 9:
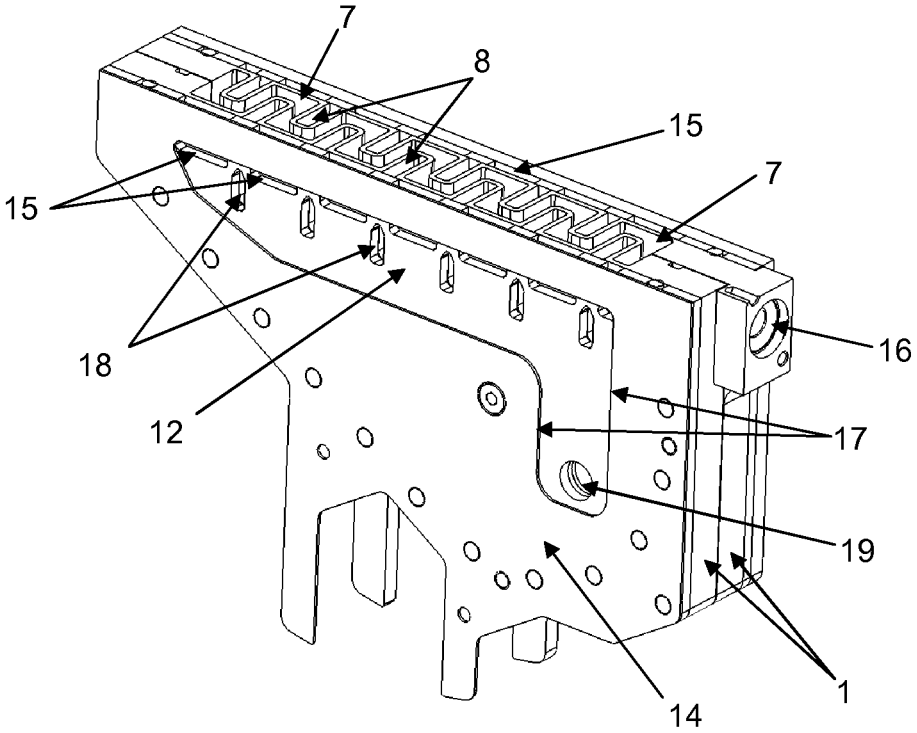
FIG. 9 is showing a cross view of a flow plate with the heat transfer system.

FIG. 9 is showing a cross view of flow plate 1 and a barrier plate 14 which barrier plate has a cut-open part 17 which is seen in FIG. 9. Barrier plate 14 is sectioned lengthwise that it is possible to see cut-open part 17 in FIG. 9 and to see part of turbulator plate 12. Cut-open part 17 makes it also possible to distribute utility fluids to utility channels 15 and to deep groves 8. Each turbulator plate 12 has two sets of holes 18 on each end of turbulator plate 12. Holes 18 are lined up in rows one row on each end of turbulator plate 12. Holes 18 together with utility channels 15 are for distributing heat transfer fluids to the deep grooves 8 and to utility sides 3 for heat transfer to or from channel 7. An inlet 19 or an outlet 19 is distributing heat transfer fluids to or from utility sides 3. FIG. 9 shows also one port 16 which communicates with channel 7.

Figure 10:
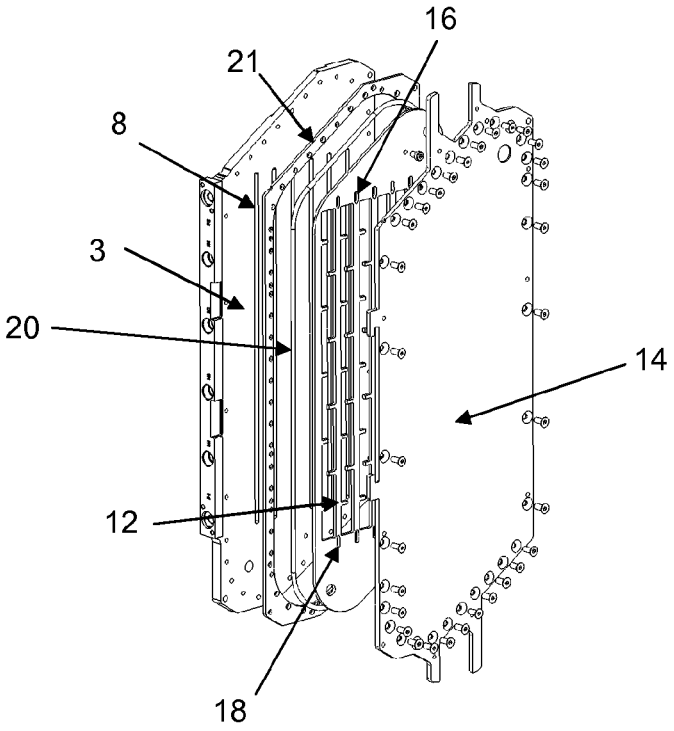
FIG. 10 is showing a blown apart part view of a flow plate from the utility side.
Figure 11:
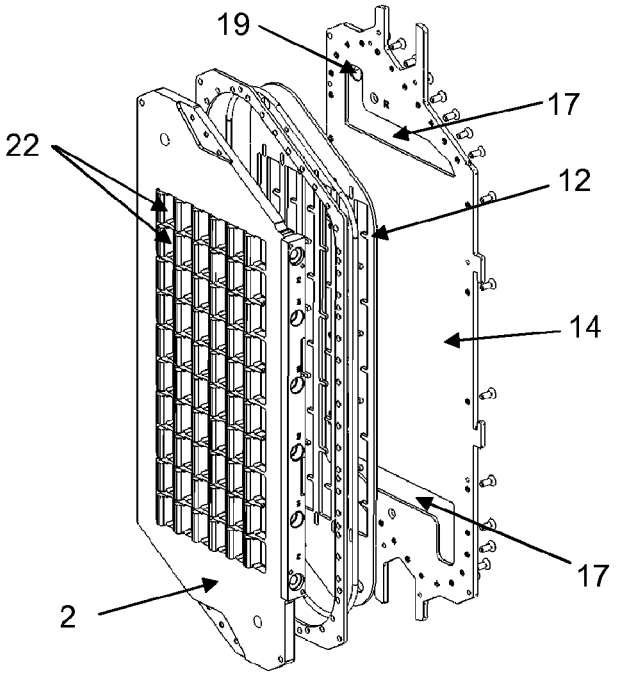
FIG. 11 is showing a blown apart part view of a flow plate seen from the channel side.

FIG. 10 is showing a blown apart part view of flow plate 1 seen from utility side 3, and FIG. 11 is showing a blown apart part view of flow plate 1 seen from channel side 2. FIG. 10 is showing how grooves 8 are arranged in parallel rows, the rows are perpendicular to channel 7 of flow plate 1, channel 7 is not seen in FIG. 10. Turbulator plate 12 could be sealed with an O-ring 20 against a frame plate 21 between utility side 3 of flow plate 1 and barrier plate 14. Two sets of holes 18 are provided in turbulator plate 12 for communication and transport of heat transfer fluids to grooves 8. Frame plate 21 may be integrated with utility side 3 of flow plate 1 as one alternative or frame plate 21 could be integrated with barrier plate 14 as another alternative, but frame plate 21 could also be a separate plate as shown in FIG. 10. In FIG. 10 cut-open part 17 can not be seen since barrier plate 14 is not sectioned in this figure and the view of barrier plate 14 is from the outside.

FIG. 11 is showing a blown apart part view of flow plate 1 together with a turbulator plate 12 and a barrier plate 14 seen from channel side 2 and FIG. 11 is disclosing that flow plate 1 comprises channel 7 which could change direction in at least one turning box, not seen in FIG. 11 or FIG. 10. A turning box, which can bee seen in FIG. 14, could be arranged between two adjacent channel rows 22 forming two compartments in a space between two adjacent channel rows 22 in flow plate 1 and one inner side of the flow plate. The compartments could be divided by a wall to create a three dimensional flow resulting in an enhanced mixing, and that fluids may flow from a first channel row to a second row in the turning box. Grooves 8 are arranged in rows perpendicular to channel rows 22 of the flow plate. Cut-open part 17 can be seen in FIG. 11 since barrier plate 14 is seen from channel side 2. Inlet 19 or outlet 19 can also be seen in FIG. 11.

Figure 12:
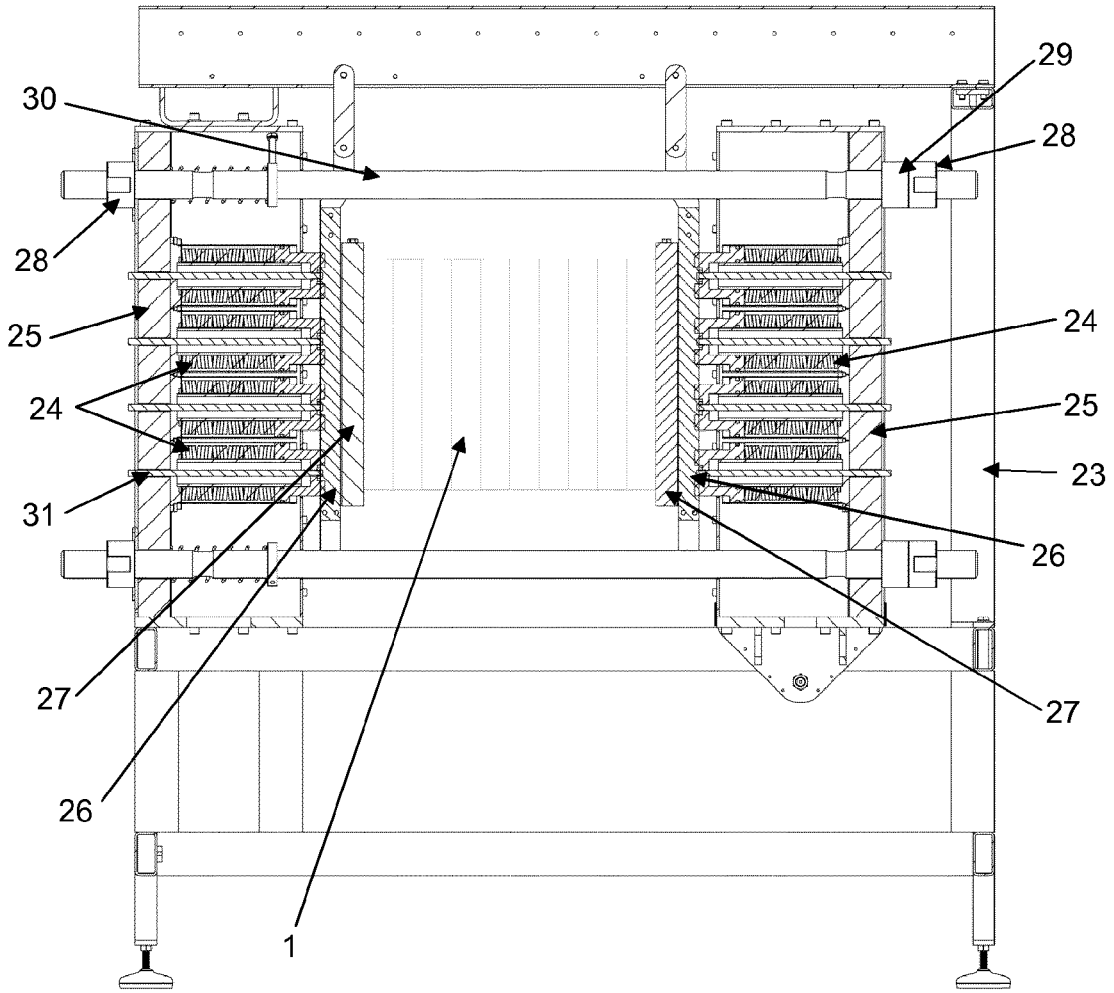
FIG. 12 is showing flow plates within a frame or a clamping device.

FIG. 12 is showing a clamping device which comprises flow plates 1, frame 23, grids of springs 24 and end plates 25 forming when assembled a flow module. Flow plates 1 are assembled within frame 23. Frame 23 is holding flow plates 1 into place between two distribution plates 26, together with two pressure plates 27 between two end plates 25. Flow plates 1 could be put into place and compressed by aid of hydraulic cylinders tensioning the tension rods. Flow plates 1 are kept in place by the force from grids of springs 24 and end plates 25, nuts 28 could be tightened and the force from hydraulic cylinders could be released. The two end plates 25 are positioned so that the intended number of flow plates 1 can be entered between them when in open position. The distance between end plates 25 may be adjusted by choosing the number of sleeves 29 and tightening of nuts 28 on one end of each tension rod 30.

Distribution plates 26 distribute the force contributions from the grids of springs 24 and end plates 25. The force on flow plates 1 can be measured by measuring the distance between one end plate 25 and how far indicator pins 31 have reached outside end plate 25. The flow module could be a plate reactor.

Figure 13:
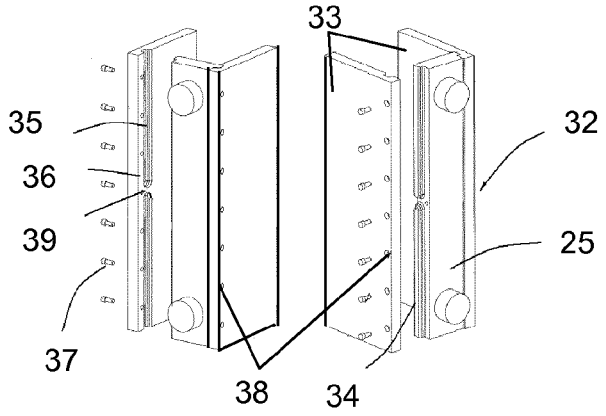
FIG. 13 is showing a U-formed end plate section.

FIG. 13 is showing U-formed end sections 32 which could be assembled with frame 23. Each U-formed end sections 32 comprise an end plate 25 and two elongated beam webs 33. The two elongated beam webs 33 could be arranged on each side of end plate 25 forming a U-shape beam construction. Each edge of the long side of end plates 25 may be stepped, i.e. the edge has a tongue 34 of about half the thickness of the edge. Each beam web 33 has a notch 35 along an edge of its long side 36. To fix beam webs 33 and end plates 25 together bolts 37 are arranged in through holes 38 along the edge of beam webs 33 and fastened in corresponding holes in end plates 25 and tongue 34 is fitted into the notches 35 of the beam webs 33. To further fix the position of the beam webs 33 in relation to end plates 25 and strengthen the design, notches 35 may have bridges 39 i.e. interruptions in notches 35 at strategic positions, which bridges 39 correspond to interruptions in tongues 34 at the same positions.

Figure 14:
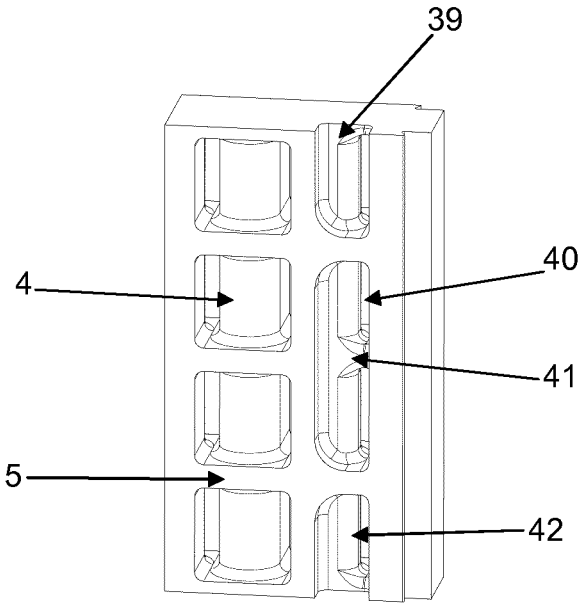
FIG. 14 is showing a sectioned part of a flow-plate having turning boxes.

FIG. 14 is showing a part of a flow-plate having turning boxes 39. The flow-plate of FIG. 14 is sectioned that it is possible to see the top part of obstacles 4 and turning boxes 39. Turning boxes 39 have two compartments 40 corresponding to the space between two adjacent channel rows. The two compartments 40 are divided by wall 41 which is an elongation of sidewall 5 but has a different height for providing contact between the two compartments. Two mini-obstacles 42 one in each compartment have also a different height compared to obstacles 4. The height of mini-obstacles 42 correspond with the height of wall 41 and provide a three dimensional flow in channel 7 resulting in an enhanced mixing, and that fluids may flow from a first channel row to a second row in turning boxes 39.

Figure 15:
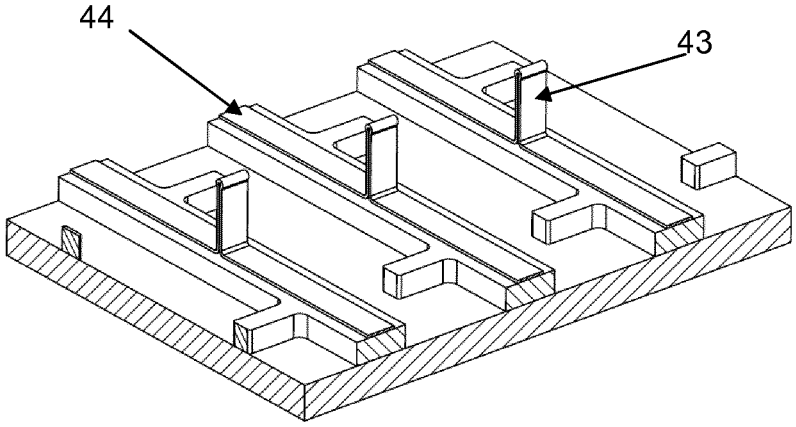
FIG. 15 is showing turbulator wings inserted into the grooves.
Figure 16:
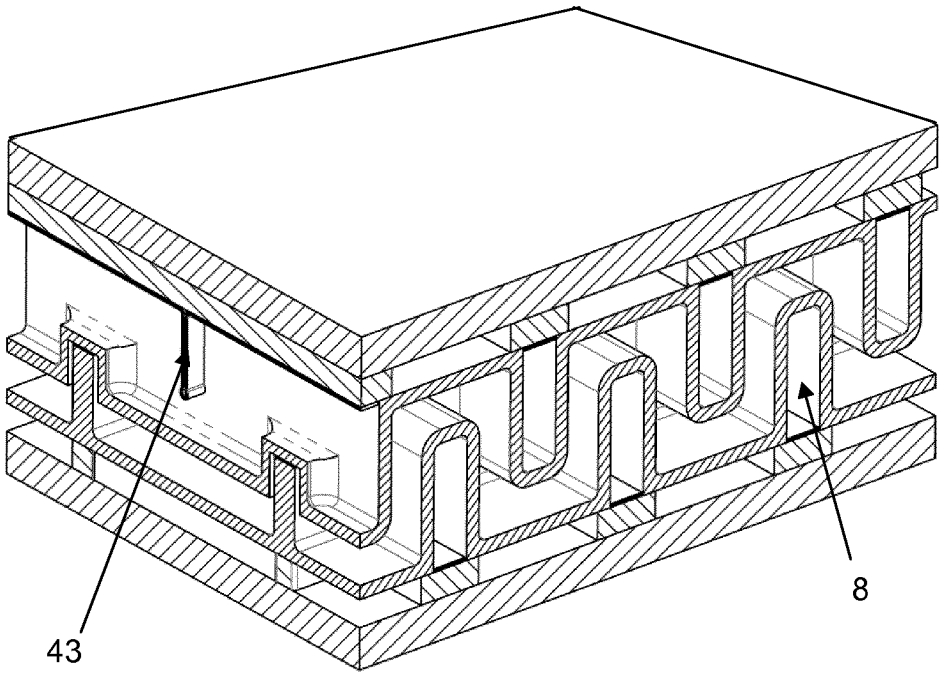
FIG. 16 is showing the turbulator wings in an assembled flow plate.

FIG. 15 is showing turbulator wings 43 which can be inserted into the grooves. Wings 43 are arranged on strips 44 which are connected to turbulator 12. FIG. 16 is showing turbulator wings 43 inserted into grooves 8 in an assembled flow plate. The addition of turbulator wings 43 will enhance turbulence within the grooves and thus heat transfer. Other types of turbulators which can be inserted into grooves 8 could be metallic foam, or offset strip fin turbulators.

Figure 17:
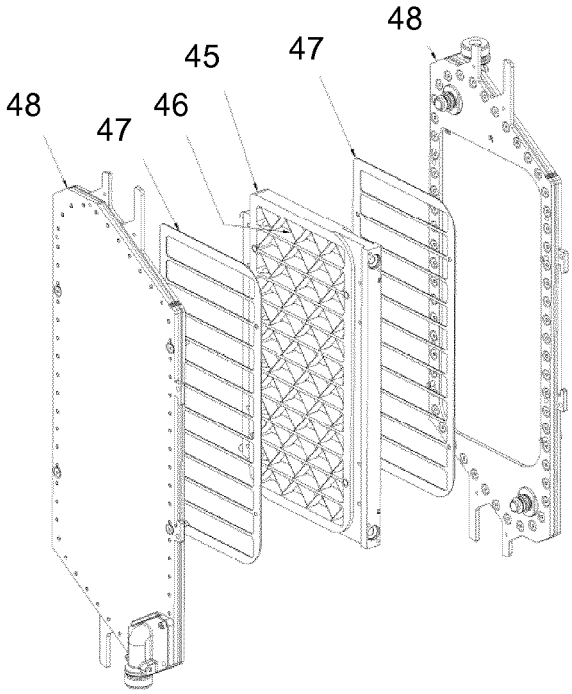
FIG. 17 is showing a residence time plate.

FIG. 17 is showing a residence time plate 45, residence time plate 45 comprises two or more chambers connected in series, the chambers are separated by parallel walls, each wall has a hole or a passage, which hole or passage is a communication between two cambers, the holes or the passages are alternating on the right hand side or the left hand side of residence time plate 45. Residence time plate 45 has at least one inlet and at least one outlet. The chambers could be equipped with inserts selected from the group consisting of folded sheet inserts 46, baffle ladder sheet inserts, stacked sheets inserts, metallic foam, offset strip fin turbulators or combinations thereof.

Preferably the inserts are folded sheet inserts 46, which comprise baffles which are shifting place in each fold in an alternating fashion that they form a zigzag pattern with alternating heights of the baffles.

On each side of residence time plate 45 is a gasket 47 for sealing the residence time plate. Residence time plate 45 and gaskets 47 are placed within at least one utility plate 48 when the flow module is assembled.

The flow module of the present invention is useful when undertaking the following process operations; manufacturing, reactions, mixing, blending, doing cryogenic operations, washing, extractions and purifications, pH adjustment, solvent exchanges, manufacturing of chemicals, manufacturing of intermediate chemicals, manufacturing API (active pharmaceutical ingredients) when working with low temperature operations, manufacturing of pharmaceutical intermediates, scale-up and scale-down developments, precipitation or crystallisations, performing multiple injections or multiple additions or multiple measurements or multiple samplings, working with multistep reactions, pre-cooling operations, preheating operations, post-heating and post-cooling operations, processes for converting batch processes to continuous processes, and operations for dividing and recombining flows.

Reaction types which can be preformed in the present invention include addition reactions, substitution reactions, elimination reactions, exchange reactions, quenching reactions, reductions, neutralisations, decompositions, replacement or displacement reactions, disproportionation reactions, catalytic reactions, cleaving reactions, oxidations, ring closures and ring openings, aromatization and dearomatization reactions, protection and deprotection reactions, phase transfer and phase transfer catalysis, photochemical reactions, reactions involving gas phases, liquid phases and solid phases, and which may involve free radicals, electrophiles, neucleophiles, ions, neutral molecules, etc.

Synthesis such as amino acid synthesis, asymmetric synthesis, chiral synthesis, liquid phase peptide synthesis, olefin metathesis, peptide synthesis, etc. can also be carried out with the flow module. Other types of synthesis in which the flow module can be used are reactions within carbohydrate chemistry, carbon disulfide chemistry, cyanide chemistry, diborane chemistry, epichlorohydrin chemistry, hydrazine chemistry, nitromethane chemistry, etc. or synthesis of heterocyclic compounds, of acetylenic compounds, of acid chlorides, of catalysts, of cytotoxic compounds, of steroid intermediates, of ionic liquids, of pyridine chemicals, of polymers, of monomers, of carbohydrates, of nitrones etc.

The flow module is suitable for name reactions such as Aldol condensations, Birch reductions, Baeyer-Villiger oxidations, Curtius rearrangements, Dieckmann condensations, Diels-Alder reactions, Doebner-Knoevenagel condensations, Friedel-Crafts reactions, Fries rearrangements, Gabriel synthesis, Gomberg-Bachmann reactions, Grignard reactions, Heck reactions, Hofmann rearrangements, Japp-Klingemann reactions, Leimgruber-Batcho indole synthesis, Mannich reactions, Michael additions, Michaelis-Arbuzov reactions, Mitsunobu reactions, Miyaura-Suzuki reactions, Reformatsky reactions, Ritter reactions, Rosenmund reductions, Sandmeyer reactions, Schiff base reductions, Schotten-Baumann reactions, Sharpless epoxidations, Skraup synthesis, Sonogashira couplings, Strecker amino acid synthesis, Swern oxidations, Ullmann reactions, Willgerodt rearrangements, Vilsmeier-Haack reactions, Williamson ether synthesis, Wittig reactions etc.

Further reactions which the flow module is suitable for are condensation reactions, coupling reactions, saponifications, ozonolysis, cyclization reactions, cyclopolymerization reactions, dehalogenations, dehydrocyclizations, dehydrogenations, dehydrohalogennations, diazotizations, dimethyl sulphate reactions, halide exchanges, hydrogen cyanide reactions, hydrogen fluoride reactions, hydrogenation reactions, iodination reactions, isocyanate reactions, ketene reactions, liquid ammonia reactions, methylation reactions, coupling, organometallic reactions, metalation, oxidation reactions, oxidative couplings, oxo reactions, polycondensations, polyesterifications, polymerization reactions, other reaction such as acetylations, arylations, acrylations, alkoxylations, ammonolysis, alkylations, allylic brominations, amidations, aminations, azidations, benzoylations, brominations, butylations, carbonylations, carboxylations, chlorinations, chloromethylations, chlorosulfonations, cyanations, cyanoethylations, cyano-methyl-lations, cyanurations, epoxidations, esterifications, etherifications, halogenations, hydroformylations, hydro-silylations, hydroxylations, ketalizations, nitrations, nitro-methylations, nitrosations, peroxidations, phosgenations, quaternizations, silylations, sulfochlorinations, sulfonations, sulfoxidations, thiocarbonylations, thiophosgenations, tosylations, transaminations, transesterifications, etc.

The present invention is further defined by the independent claims and the dependent claims.

The invention claimed is:

1. A flow-plate, said flow plate being dividable in mid plane and comprising:

a first part and a second part, each of the first and second parts comprising a channel side and a utility side, wherein the first and second parts are counter parts that cooperate with each other, wherein each channel side comprises parallel rows of obstacles, sidewalls and parallel rows of channel floors, said sidewalls separating said parallel rows of obstacles, said sidewalls separating said parallel rows of channel floors, and said rows of obstacles cooperating with said rows of channel floors to form a channel between the two channel sides of said flow plate, wherein the obstacles of the second part each comprise a first wall, a second wall opposite the first wall, and a third wall extending between the first wall and second wall, wherein the obstacles of the second part extend toward the first part, the obstacles of the second part being between the obstacles of the first part, and wherein the utility sides of the rows of obstacles have deep grooves on the utility sides of said flow-plate between the first wall and second wall of the obstacles.

2. A flow-plate, said flow plate being dividable in mid plane and comprising:

a first part and a second part, each of the first and second parts comprising a channel side and a utility side, wherein the first and second parts are counter parts that cooperate with each other, wherein each channel side comprises parallel rows of obstacles, sidewalls and parallel rows of channel floors, said sidewalls separating said parallel rows of obstacles, said sidewalls separating said parallel rows of channel floors, and said rows of obstacles cooperating with said rows of channel floors to form a channel between the two channel sides of said flow plate, and wherein the utility sides of the rows of obstacles have deep grooves, said deep grooves being lined up in parallel rows on the utility sides of said flow-plate, the rows of deep grooves being perpendicular to the channel, and the rows of deep grooves being for the flow of heat transfer fluids on the utility sides, two barrier plates and two turbulator plates, said turbulator plates being designed to cover the deep grooves, and the two barrier plates closing the utility sides, wherein one barrier plate on each of the opposite utility sides creates utility channels, wherein each barrier plate has cut-open parts for distribution of heat transfer fluids, and wherein inlets or outlets are respectively arranged in the cut-open parts for heat transfer fluids.

3. The flow-plate according to claim 1, wherein one or more access ports, or one or more port holes, or combinations thereof provide access to the channel, at least one of the access ports or at least one of the port holes, or combinations thereof, is an inlet connected to the channel, and at least one of the access ports or at least one of the port holes, or combinations thereof, is an outlet connected to the channel.

4. A flow-plate, said flow plate being dividable in mid plane and comprising:

a first part and a second part, each of the first and second parts comprising a channel side and a utility side, wherein the first and second parts are counter parts that cooperate with each other, wherein each channel side comprises parallel rows of obstacles, sidewalls and parallel rows of channel floors, said sidewalls separating said parallel rows of obstacles, said sidewalls separating said parallel rows of channel floors, and said rows of obstacles cooperating with said rows of channel floors to form a channel between the two channel sides of said flow plate, wherein the utility sides of the rows of obstacles have deep grooves, said deep grooves being lined up in parallel rows on the utility sides of said flow-plate, the rows of deep grooves being perpendicular to the channel, and the rows of deep grooves being for the flow of heat transfer fluids on the utility sides, and wherein the sidewalls are fitted in bars in the deep grooves.

5. The flow-plate according to claim 1, wherein the two counter parts of the flow plate are moulded, are machined or are combinations of moulded and machined.

6. The flow-plate according to claim 4, wherein clearance slots between the sidewalls and the bars are for small bypass to keep clean during operation and for improving handling of flow plates during assembling and during dissembling.

7. The flow-plate according to claim 1, wherein the flow-plate also has turning boxes, each turning box comprising two compartments divided by a wall, in each compartment is one mini-obstacle arranged for creating a three dimensional flow and enhanced mixing in the channel, and fluids flow from a first channel row to a second channel row in the turning box.

8. The flow-plate according to claim 1, wherein the deep grooves have inserted turbulators selected from metallic foam, offset strip fin turbulators, or turbulator wings arranged on strips connected to the turbulator, and wherein the inserted turbulators are for enhancing turbulence within the deep grooves.

9. An assembled flow-plate section, comprising:

a flow-plate, said flow-plate being dividable in mid plane and being the core of the flow-plate section, wherein the flow-plate comprises two channel sides and two utility sides, wherein sidewalls extend from each channel side, wherein a channel is formed between the two channel sides by obstacles, wherein the channel is sealed by a gasket between the sidewalls extending from each channel side, wherein a height of each obstacle is greater than a height of each side wall, wherein the obstacles of a first channel side extend toward a second channel side, the obstacles of the first channel side being between the obstacles of the second channel side in a flow direction of the channel, wherein the channel is sealed by a gasket between the two channel sides, wherein the two utility sides are lined up by backsides of the obstacles, wherein the backsides of the obstacles have deep grooves for heat transfer fluids, wherein on each of the two utility sides is a frame plate, an O-ring, a turbulator plate, and a barrier plate, and wherein the two barrier plates close the assembled flow-plate section.

10. The assembled flow-plate section according to claim 9, further comprising two barrier plates and two turbulator plates, said turbulator plates being designed to cover the deep grooves, and the two barrier plates closing the utility sides, wherein one barrier plate on each of the opposite utility sides creates utility channels, wherein each barrier plate has cut-open parts for distribution of heat transfer fluids into the deep grooves and into the utility channels formed by the turbulator plates and the barrier plates, and wherein inlets or outlets are respectively arranged in the cut-open parts for heat transfer fluids.

11. A flow module, comprising:

one or more of the assembled flow plate sections according to claim 9; and a clamping device, wherein the clamping device comprises a frame, two end plates, disc springs, and tension rods, and wherein piles of disc springs are arranged as a grid of springs supported on end plates to distribute clamping forces on the flow plates, the flow plates placed between the two end plates.

12. The flow module according to claim 11, wherein the clamping device comprises two U-formed end sections comprising the end plates, two beam webs at each of the end plates, and wherein each of long sides of the beam webs has at least one notch in which at least one tongue of the end plate is fitted, in such a way that a U-formed end section is formed.

13. The flow module according to claim 11, further comprising one or more residence time plates comprising two or more chambers connected in series, wherein the chambers are separated by parallel walls, each wall having a hole or a passage, which hole or passage is a communication between two of the two or more chambers, wherein the holes or the passages alternate on the right hand side or the left hand side of one or more residence time plates, wherein the one or more residence time plates have at least one inlet and at least one outlet, and wherein the chambers are equipped with inserts selected from the group consisting of folded sheet inserts, baffle ladder sheet inserts, stacked sheets inserts, metallic foam, offset strip fin turbulators or combinations thereof.

14. The flow module according to claim 13, wherein the inserts are folded sheet inserts, comprising baffles that shift place in each fold in an alternating fashion to form a zigzag pattern with alternating heights of the baffles.

15. A method comprising the step of using the flow module according to claim 11 as a reactor for chemical reactions.

16. The flow-plate according to claim 1, further comprising a turbulator plate on the first part and covering the deep grooves, wherein the deep grooves have inserted turbulators selected from metallic foam, offset strip fin turbulators, or turbulator wings arranged on strips connected to the turbulator plate.

17. A plate reactor, comprising:

one or more of the assembled flow plate sections according to claim 9; and a clamping device, wherein the clamping device comprises a frame, two end plates, disc springs, and tension rods, and wherein piles of disc springs are arranged as a grid of springs supported on end plates to distribute clamping forces on the flow plates, the flow plates placed between the two end plates.

18. The flow-plate according to claim 2, wherein each turbulator plate has two sets of holes lined up in rows, one row on each end of the turbulator plate, said sets of holes together with cut-open parts being for distributing heat transfer fluids to the deep grooves and to utility channels for heat transfer to or from the channel.

19. The flow-plate according to claim 2, wherein one or more access ports, or one or more port holes, or combinations thereof provide access to the channel, at least one of the access ports or at least one of the port holes, or combinations thereof, is an inlet connected to the channel, and at least one of the access ports or at least one of the port holes, or combinations thereof, is an outlet connected to the channel.

* * * * *